US009194593B2

(12) United States Patent
Uselton

(10) Patent No.: US 9,194,593 B2
(45) Date of Patent: Nov. 24, 2015

(54) ICING PROTECTION FOR A HEAT PUMP

(71) Applicant: Lennox Industries Inc., Richardson, TX (US)

(72) Inventor: Robert B. Uselton, Carrollton, TX (US)

(73) Assignee: Lennox Industries Inc., Richardson, TX (US)

( * ) Notice: Subject to any disclaimer, the term of this patent is extended or adjusted under 35 U.S.C. 154(b) by 213 days.

(21) Appl. No.: 13/919,521

(22) Filed: Jun. 17, 2013

(65) Prior Publication Data

US 2014/0366570 A1 Dec. 18, 2014

(51) Int. Cl.
*F24F 13/20* (2006.01)
*F24F 1/58* (2011.01)

(52) U.S. Cl.
CPC ..... *F24F 1/58* (2013.01); *F24F 2013/205* (2013.01); *Y10T 29/49245* (2015.01)

(58) Field of Classification Search
CPC ..... F24F 13/20; F24F 2013/205; F24F 1/58; F24F 13/08; F24F 1/56; F24F 2013/202; Y10T 29/49245
USPC ..... 62/426, 507, 508; 454/329; 29/888.025
See application file for complete search history.

(56) References Cited

U.S. PATENT DOCUMENTS

| | | | | |
|---|---|---|---|---|
| 5,117,656 | A * | 6/1992 | Keck et al. | 62/506 |
| 5,311,747 | A * | 5/1994 | Pringle et al. | 62/183 |
| 5,393,224 | A * | 2/1995 | Allen et al. | 431/266 |
| 7,032,402 | B2 * | 4/2006 | Braswell | 62/259.1 |
| 2003/0221440 | A1 * | 12/2003 | Limehouse | 62/305 |
| 2006/0059935 | A1 * | 3/2006 | Braswell | 62/259.1 |
| 2007/0296315 | A1 * | 12/2007 | Francisquini | 312/236 |

* cited by examiner

*Primary Examiner* — Mohammad M Ali
(74) *Attorney, Agent, or Firm* — Winstead PC

(57) ABSTRACT

A protective housing is provided for a heating, ventilation, and air conditioning (HVAC) unit having a fan therein. The fan comprises a plurality of blades, each blade having a proximal and distal end. The housing comprises a plurality of side panels, each side panel comprising openings enabling airflow into the housing. The housing further comprises an access panel that is coupled between two of the plurality of side panels wherein the access panel and the plurality of side panels form an enclosure. An orifice ring is mounted within the housing, wherein a running clearance between the distal end of the fan blades and the orifice ring has a first spacing. A cover fastens atop the enclosure, the cover comprising a grill having a plurality of grill members, wherein the grill members are separated by a second spacing, the second spacing being smaller than the first spacing.

18 Claims, 5 Drawing Sheets

ICING PROTECTION FOR A HEAT PUMP

TECHNICAL FIELD

This application is directed, in general, to heating, ventilation, and air conditioning (HVAC) units and, more specifically, to a housing for outdoor HVAC components such as a heat pump which provides icing protection for the component(s) therein.

BACKGROUND

Heat pumps sometimes operate in conditions of freezing precipitation such as freezing rain, snow, sleet, hail, and the like. Most heat pumps use a top discharge fan system located outdoors. The air leaving the heat pump, through the fan, orifice ring and grill, has been chilled below the ambient temperature. Freezing precipitation can form ice in the fan system and impair operation of the fan and the heat pump. Although the fan and heat pump may continue to operate, objectionable noise may occur as a result of ice buildup and ice-bridging. As a result, HVAC service personnel are often called to service the heat pump on the perception that the heat pump is not functioning properly. Further, if enough ice buildup occurs, the unit may experience a reduced airflow or complete loss of airflow causing the heat pump to operate at a reduced output and heating efficiency.

SUMMARY

One aspect provides a protective housing for a heating, ventilation, and air conditioning (HVAC) unit having a fan therein. The fan comprises a plurality of blades, each having a proximal and distal end. The housing comprises a plurality of side panels, an access panel, an orifice ring mounted within the housing, and a cover. Each side panel comprises openings enabling airflow into the housing. The access panel may be coupled between two of the plurality of side panels such that the access panel and the plurality of side panels form an enclosure. The orifice ring is mounted within the housing, wherein a running clearance between the distal end of the fan blades and the orifice ring has a first spacing. The cover may be fastened atop the enclosure and comprise a grill having a plurality of grill members, wherein the grill members are separated by a second spacing, which is smaller than the first spacing. In some embodiments, the side panels may also comprise relief air vents similar to the vent comprising the access panel in order to allow even better airflow for the components within the housing.

Another aspect provides a method of manufacturing a protective housing for a heating, ventilation, and air conditioning (HVAC) unit having a fan therein, the fan comprising a plurality of blades, each having a proximal and distal end. The method comprises providing a plurality of side panels, each side panel comprising openings enabling airflow into the housing; providing an access panel; coupling the access panel between two of the plurality of side panels wherein the access panel and the plurality side panels collectively form an enclosure; mounting an orifice ring within the housing, wherein a running clearance between the distal end of the fan blades and the orifice ring has a first spacing; and fastening a cover atop the enclosure, the cover comprising a grill having a plurality of grill members, wherein the grill members are separated by a second spacing, which is smaller than the first spacing.

In another embodiment an HVAC system comprises at least one indoor component and at least one outdoor component comprising at least a fan, the outdoor component(s) housed within a housing. The housing may comprise a plurality of side panels, an access panel, an orifice ring mounted within the housing, and a cover. Each side panel comprises openings enabling airflow into the housing. The access panel may be coupled between two side panels such that the access panel and side panels form an enclosure. The orifice ring is mounted within the housing, wherein a running clearance between the fan and the orifice ring has a first spacing. The cover may be fastened atop the enclosure, and comprise a grill having a plurality of grill members, wherein the grill members are separated by a second spacing, which is smaller than the first spacing.

BRIEF DESCRIPTION

Reference is now made to the following descriptions taken in conjunction with the accompanying drawings, in which.

DETAILED DESCRIPTION

Figure 1A:
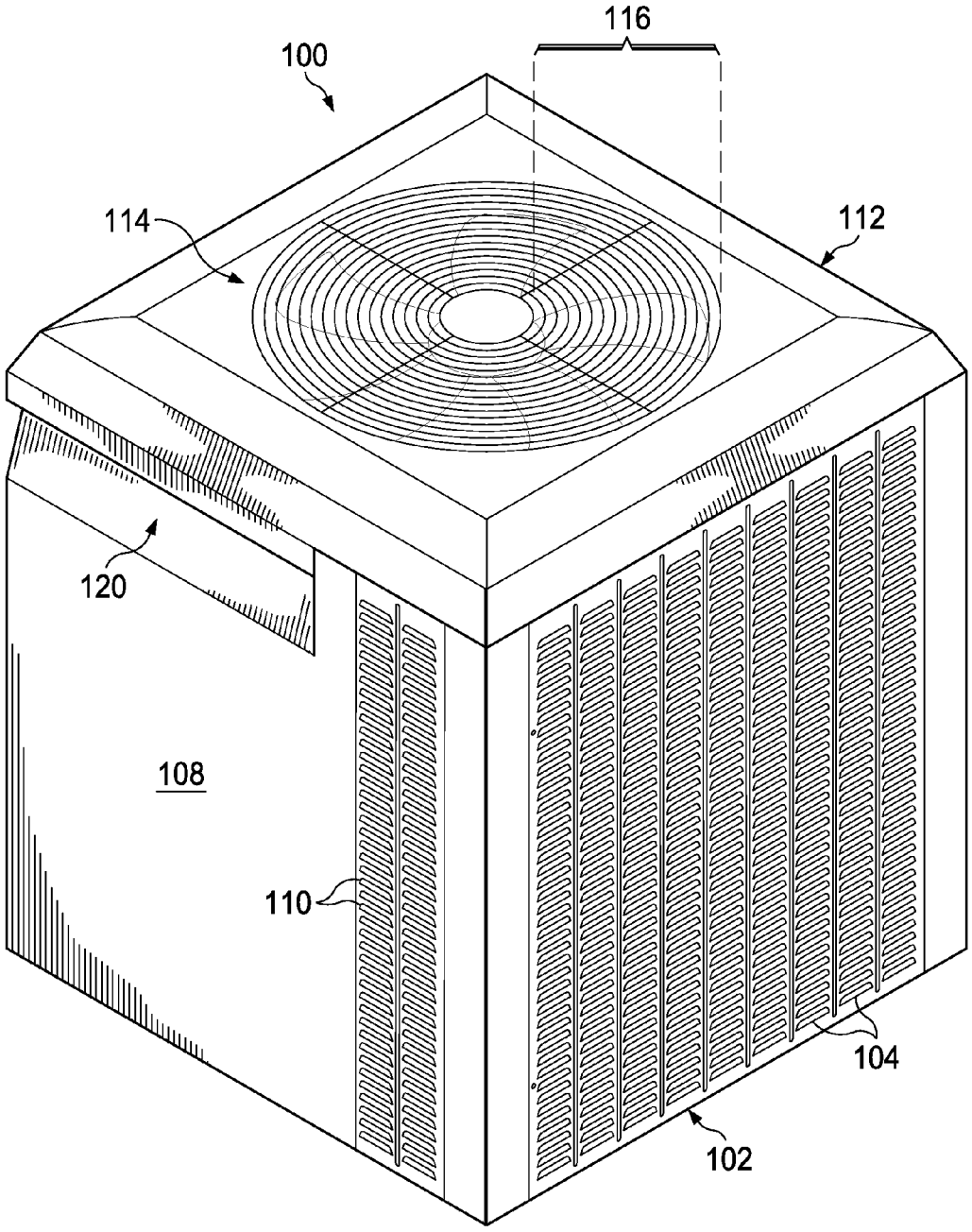
FIG. 1A is a perspective view of one embodiment of a housing for an HVAC unit according to the present disclosure.

Heat pumps operating under severe operating conditions experience ice buildup referred to as ice-fouling and ice-bridging of the fan/orifice ring system. To reduce ice buildup conditions, one embodiment of this disclosure provides a discharge grill that has a spacing between grill members of the discharge grill that are smaller than a spacing defining a minimum running clearance between a fan and orifice ring comprising an outdoor HVAC unit such as a heat pump system. In outdoor HVAC units such as heat pumps which utilize a top discharge fan system, a grill atop the unit facilitates airflow through unit. In traditional units, the spacing between grill members, such as grates, fins, louvers, and the like, are spaced large enough to facilitate as much airflow as possible through the unit, but small enough to meet industry safety standards for protection of personnel from moving or hazardous parts. Accordingly, reducing the spacing between the grill members according to the present disclosure is counterintuitive to industry design standards because adding more closely spaced members may be perceived as restricting or reducing airflow.

When exposed to freezing precipitation, traditionally spaced discharge grills tend to experience ice buildup on the surface of the grill between grill members, which is generally the point of discharge of the cold exhaust air from the outdoor unit. As a result, the unit can completely freeze-over and seal the fan system beneath from further accumulation of ice. However, while the fan may continue to turn and the heat pump will continue to operate, an evaporator component of the heat pump will not receive enough air flow and the heat pump will be operating at a reduced heating and energy efficiency.

Further, prior to the ice buildup and formation, precipitation falls through the grill members and thereafter forms ice on the fan, orifice ring, and in the clearance therebetween. As a result, the fan contacts the ice buildup and thereafter creates an objectionable noise which a resident or homeowner perceives as a problem with the HVAC unit.

To mitigate the total loss of airflow when the grill ices-over and lessen the ice buildup on the fan/orifice ring system, the present disclosure provides an embodiment of a housing for the outdoor HVAC unit that mitigates the ice buildup on the fan/orifice ring system, and in another embodiment, provides a relief air passage which enables proper airflow through the unit and prevents components within the housing, such as an evaporator, from being starved for air flow.

The following discussion describes various embodiments in the context of heating an indoor ambient, such as a residential living area. Such applications are often referred to in the art as HVAC (heating-ventilating and air conditioning). Heat is described in various embodiments as being extracted from an outdoor ambient. Such references do not limit the scope of the disclosure to use in HVAC applications, nor to residential applications. As will be evident to those skilled in the pertinent art, the principles disclosed may be applied in other contexts with beneficial results, including without limitation mobile and fixed refrigeration applications. Embodiments in the following discussion may refer to systems used for heating and cooling a residential living space without loss of generality.

Referring now to FIG. 1A, there is shown one embodiment of a protective housing 100 for a heat pump system according to the present disclosure. The housing 100 comprises a plurality of side panels 102, one of which may be an access panel, with each side panel having a top and bottom end, the bottom end situated nearest the ground or support surface, and comprising openings 104, which enable airflow into the housing 100 and components therein. The openings 104 may comprise louvers, vents, one or more grills, mesh openings, and various other suitable openings for providing airflow into housing 100. In one embodiment, an access panel 108 is coupled between two of the side panels 102 wherein the access panel 108 and all of the side panels 102 form an enclosure. The access panel 108 also has a top and bottom. Some embodiments of the access panel may further comprise openings 110 which enable airflow into the housing similar to openings 104. The access panel 108 may generally comprise a removable panel which enables access to electrical components and connections within the housing 100. A cover 112 is fastened at the top of the enclosure, the cover 112 fastens to the tops of the side panels 102 and access panel 108. The cover 112 comprises a grill 114 having a plurality of grill members 116. The grill members 116 may comprise fins, grates, louvers, or various other structures utilized for outdoor HVAC units. While the grill 114 may be in various geometric shapes such as circular as shown in FIG. 1A and other various shapes known in the art, the grill members 116 are generally concentric or parallel and have a spacing "x" therebetween. The spacing "x" may vary depending on the size of the HVAC equipment but must comply with industry safety requirements, such as Underwriters Laboratories (UL), for protection of personnel from hazardous moving parts.

Figure 1B:
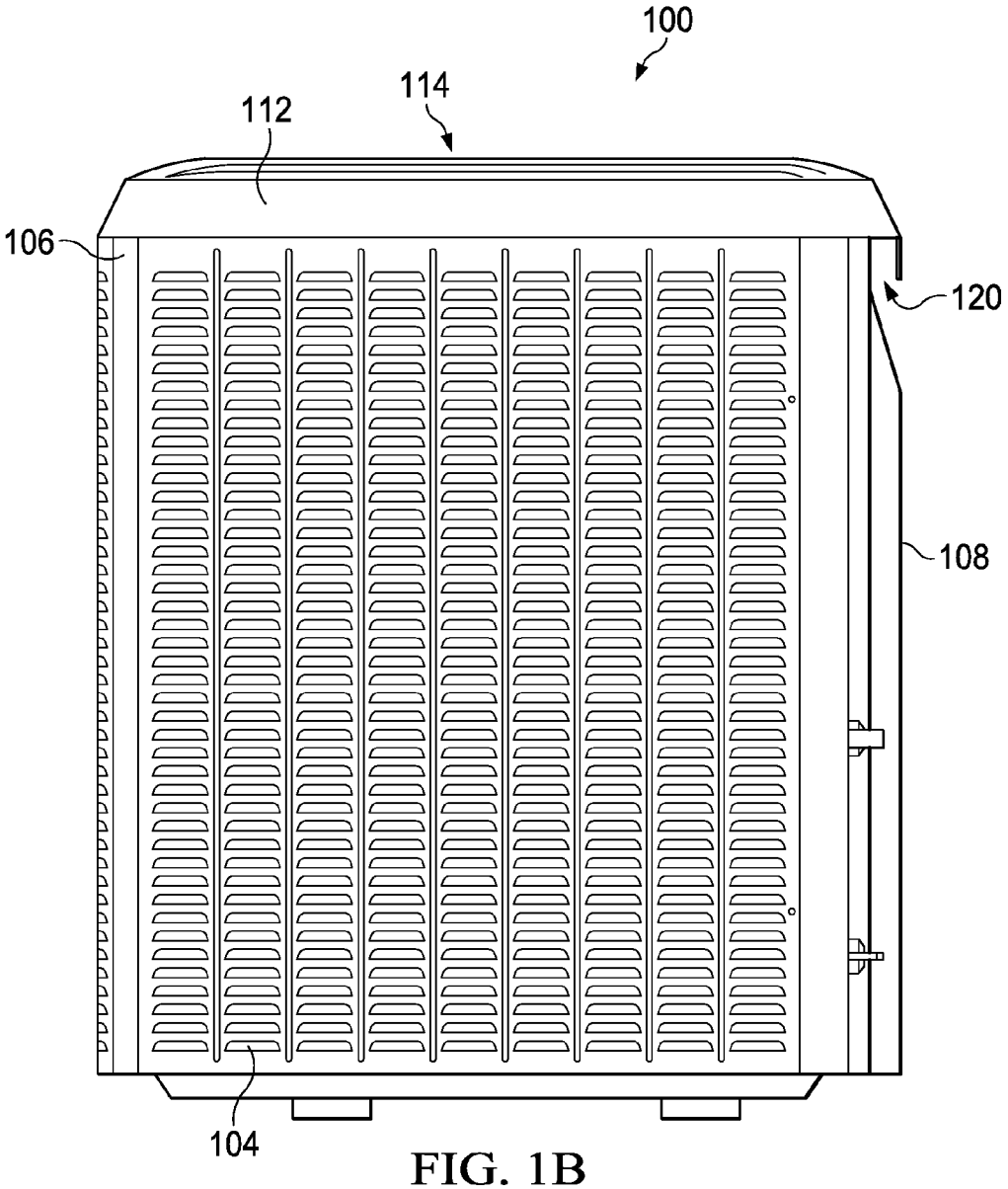
FIG. 1B is a side view of the housing for an HVAC unit shown in FIG. 1A.

Referring now to FIG. 1B, there is shown a side view of another embodiment of the housing 100. Near the top of the side access panel 108 there is an air relief vent 120. The air relief vent 120 may be formed as part of the access panel 108 or may comprise a separate panel affixed near the top of the access panel 108. As shown, the air relief vent 120 is beneath an outer perimeter of the cover 112, and is therefore, substantially shielded from freezing precipitation. In the event there is a buildup of ice on the grill 114, the HVAC unit 100 may continue to operate, but will be running at a lower efficiency, both in heating capacity and energy consumption. The air relief vent 120 mitigates a total loss of airflow through the enclosure and enables proper airflow to prevent an evaporator or similar component therein from being starved for air flow. Accordingly, the relief air vent 120 can be sized large enough to enable the proper airflow, yet still comply with industry safety standards for protection of personnel from hazardous moving parts. For example, heat pumps generally use 2500 to 4500 CFM of outdoor airflow. A relief air vent comprising about ⅓ sq. feet in area can generally allow about 700 CFM airflow therethrough, thereby enabling the heat pump to maintain a better heating output and mitigate the loss of heating and energy efficiency. In addition to the relief air vent 120 in the access panel 108, one of more of the side panels 102 may also be configured to comprise a relief air vent near the top thereof and beneath the perimeter of the cover 112, which would enable even more airflow volume through the unit 100 during ice buildup conditions. The presence of the relief air vent 120 is counter-intuitive to conventional heat pump or HVAC housing configurations because conventional housing has a top grate in which the fin or grate members are widely spaced apart.

Figure 2A:
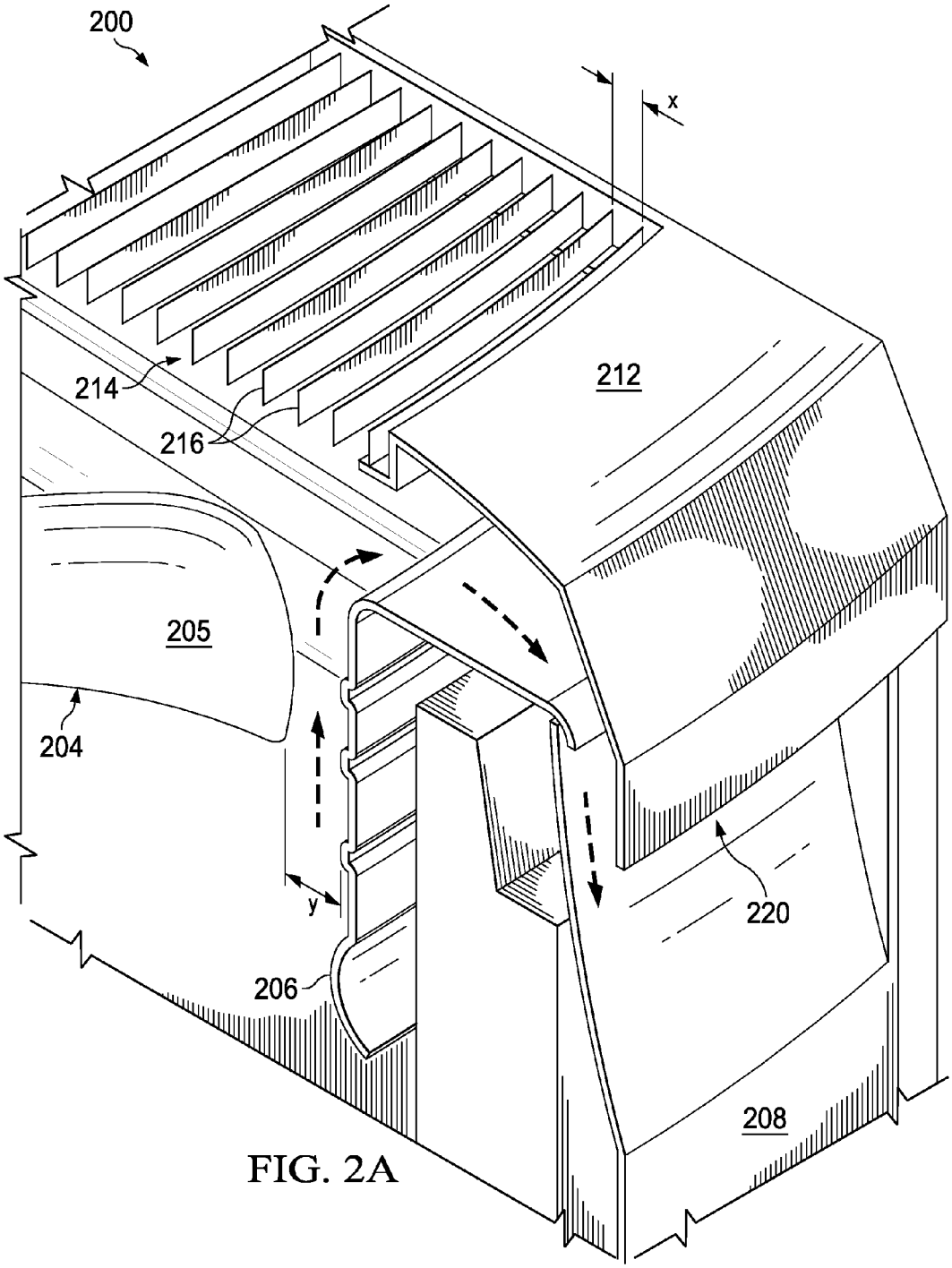
FIG. 2A is a perspective sectional view of another embodiment of a housing for an HVAC unit according to the present disclosure.

Referring now to FIG. 2A there is shown a cutaway of another embodiment of a housing 200 according to the present disclosure. Within the housing are shown components of an HVAC system, such as a heat pump. Fan 204 is mounted within the housing 200. Fan 204 may comprise multiple blades 205 having a proximal and distal end, said blades having varying shapes, such as e.g. a trapezoidal shape, a rectangular shape, a triangular shape, or any other appropriate shape, and include curved portions and/or planar portions. Fan 204 may be connected with a motor (not shown) of a compressor belonging to a heat pump or other HVAC system. Orifice ring 206 is mounted beneath cover 212 and near the tops of side panels and access panel 208 forming an enclosure beneath cover 212. The fan 204 may be disposed at least partially or fully within the orifice ring 206 and accordingly requires a fan running clearance between the distal end of fan blades 205 and orifice ring 206, the fan running clearance having a spacing "y". As discussed herein, when ice builds up or bridging occurs in the fan clearance, the unit may continue to operate, but the contact of the fan blades 205 or orifice ring 206 with the ice may create an objectionable noise such that an occupant of a building may presume there is a problem with the HVAC system and contact a vendor or technician for maintenance and/or repair. Accordingly, to limit or prevent ice buildup and bridging between the fan blades 205 and orifice ring 206, a grill 214 of cover 212 may utilize grill members 216 having a spacing "x" therebetween, wherein the spacing "x" is less than the spacing "y" between the fan 204 and orifice ring 206 such that the spacing "x" will accumulate ice and freeze over before the spacing "y" can accumulate enough ice buildup to cause any objectionable noise and/or completely ice over. Accordingly, as spacing "x" decreases, more grill members 216 may be required, but a quantity of grill members 216 increases, each grill member 216 may decrease in size and surface area such that manufacturing materials and costs remain substantially similar as compared to traditional grills.

Figure 2B:
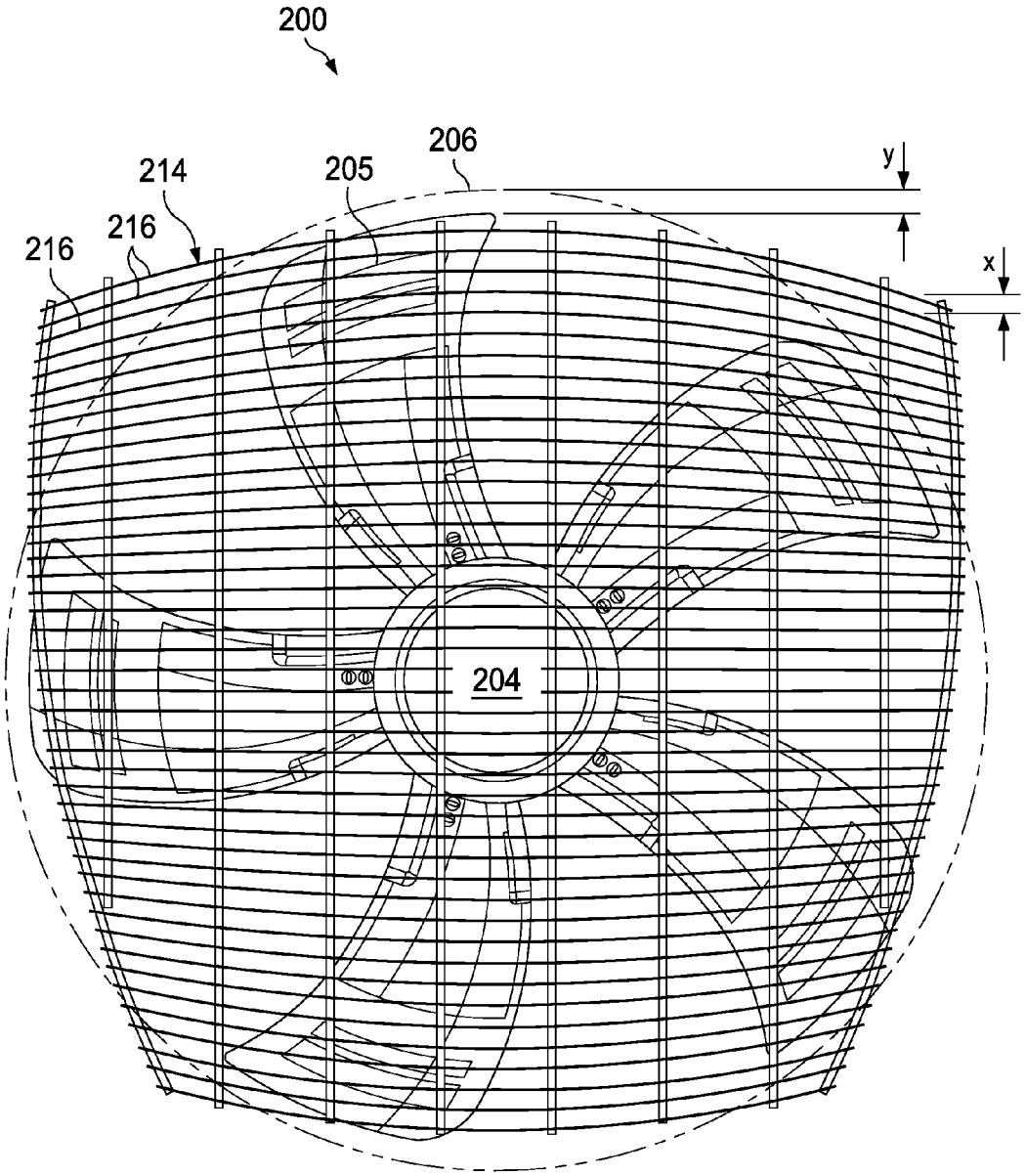
FIG. 2B is a top view of the housing for an HVAC unit shown in FIG. 2A.

Referring now to FIG. 2B, there is shown a top view of housing 200. As shown, spacing "x" between the grill members 216 is smaller than spacing "y" between the distal end of fan blades 205 and orifice ring 206 to limit ice buildup in spacing "y". In one embodiment of a heat pump, the ratio of spacing "x" measurement to fan clearance spacing "y" is about 60 percent, and in another embodiment, the ratio of spacing "x" to fan clearance spacing "y" is at about 75 percent. For example, if the running clearance spacing "y" is about 0.375 inches, the spacing "x" between the grill members 216 is about 0.225 inches. In some embodiments, additional design features may be utilized to ensure the heat pump maintains expected airflow under non-icy operating conditions. For example, as the spacing "x" decreases, the grill 214 may have a greater diameter and or perimeter such that grill 214 may comprise a greater surface area of the cover 212. Further the grill members 216 may comprise a smaller diameter, such as e.g. 0.125 inches, but be greater in number so there are more openings having spacing "x". Likewise, the fan 204 and orifice ring 206 may be positioned farther away from the cover 212 and closer to a motor of a compressor (not shown), whereby the airflow through grill 214 will experience less turbulence.

Referring again to FIG. 2A, when the spacing "x" between the grill members 216 of grill 214 do freeze over, airflow out of the housing 200 will be limited and the components within, such as an evaporator, may not receive sufficient airflow and result in less efficient heating output and energy consumption by the HVAC unit. Accordingly, in such embodiments, relief air vent 220 is provided to allow air to exit the housing in order to maintain airflow which enables the unit to continue operating and provide heat pumping. As shown in the illustrated embodiment of FIG. 2A, the relief air vent 220 begins near a top side of orifice ring 206 and extends beneath cover 212 and out from access panel 208.

Figure 3:
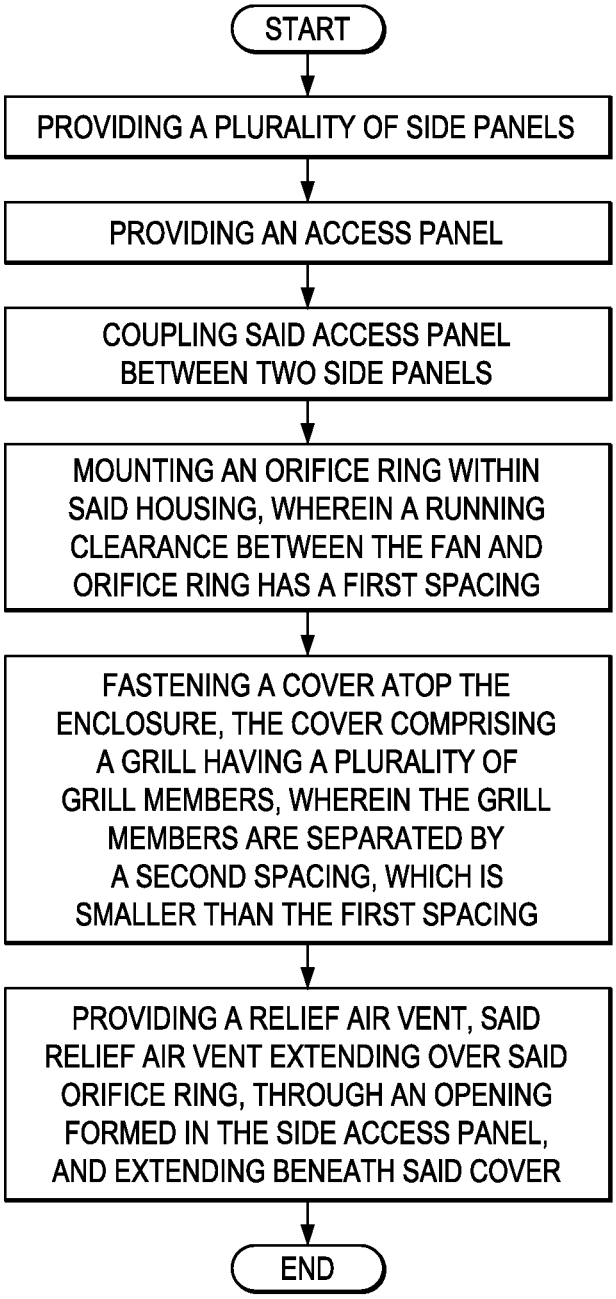
FIG. 3 is a flow diagram of a method of manufacturing another embodiment of an HVAC unit according to the present disclosure.

Referring now to FIG. 3, there is shown a flowchart for an embodiment of a method of manufacturing a protective housing for an HVAC unit having a fan therein, such as e.g. a heat pump. A plurality of side panels is provided, each side panel comprising openings enabling airflow into the housing. An access panel is provided, and the access panel is coupled between two of the plurality of side panels such that the access panel and plurality of side panels form an enclosure. Next, an orifice ring is mounted within the enclosure comprising the housing, wherein a running clearance between the fan and the orifice ring has a first spacing. Next a cover is fastened atop the enclosure, the cover comprising a grill having a plurality of grill members, the grill members separated by a second spacing, wherein the second spacing is smaller than the first spacing. In some embodiments, a relief air vent may be provided, said relief air vent extending over the orifice ring, through an opening formed in the side access panel, and extending beneath said cover. In other embodiments, relief air vents may be also provided in one or more of the plurality of side panels.

Those skilled in the art to which this application relates will appreciate that other and further additions, deletions, substitutions and modifications may be made to the described embodiments.

What is claimed is:

1. A protective housing for a heating, ventilation, and air conditioning (HVAC) unit having a fan therein, said fan comprising a plurality of fan blades each blade having a proximal and distal end, the housing comprising:

a plurality of side panels, each side panel comprising openings enabling airflow into the housing;

an access panel, said access panel coupled between two of the plurality of side panels, wherein said access panel and said plurality of side panels form an enclosure;

an orifice ring mounted within said housing, wherein a running clearance between said distal ends of said fan blades and said orifice ring has a first spacing;

a cover fastened atop the enclosure, said cover comprising a grill having a plurality of grill members, wherein said grill members are separated by a second spacing, which is smaller than the first spacing; and a relief air vent, said relief air vent extending over said orifice ring, through an opening formed in the access panel, and extending beneath said cover.

2. The housing according to claim 1, wherein the relief air vent is ⅓ square feet in area.

3. The housing according to claim 1, wherein the second spacing is 25-40 percent smaller than the first spacing.

4. The housing according to claim 1, further comprising relief air vents formed in one or more of the plurality of said side panels, said relief air vents extending over said orifice ring, through an opening formed in the one or more side panels, and extending beneath said cover.

5. The housing according to claim 1, wherein the HVAC unit is a heat pump.

6. The housing according to claim 1, wherein the fan blades are disposed fully in the orifice ring.

7. A method of manufacturing a protective housing for a heating, ventilation, and air conditioning (HVAC) unit having a fan therein, said fan comprising a plurality of fan blades each having a proximal and distal end, the method comprising:

providing a plurality of side panels, each side panel comprising openings enabling airflow into the housing;

providing an access panel;

coupling said access panel between two side panels wherein the access panel and side panels form an enclosure;

mounting an orifice ring within said housing, wherein a running clearance between said distal end of said fan blade and said orifice ring has a first spacing;

fastening a cover atop the enclosure, said cover comprising a grill having a plurality of grill members, wherein said grill members are separated by a second spacing, which is smaller than the first spacing; and providing a relief air vent, said relief air vent extending over said orifice ring, through an opening formed in the access panel, and extending beneath said cover.

8. The method according to claim 7, wherein the relief air vent is ⅓ square feet in area.

9. The method according to claim 7, wherein the second spacing is 25-40 percent smaller than the first spacing.

10. The method according to claim 7, further comprising forming relief air vents in one or more of the plurality of said side panels, said relief air vents extending over said orifice ring, through an opening formed in the one or more side panels, and extending beneath said cover.

11. The method according to claim 7, wherein the HVAC unit is a heat pump.

12. The method according to claim 7, wherein the fan blades are disposed fully in the orifice ring.

13. A heating ventilation and air conditioning system comprising:

at least one outdoor component;

at least one fan, said fan comprising a plurality of blades, each blade having a proximal and distal end;

wherein the at least one outdoor component and at least one fan are housed within a housing, the housing comprising:

a plurality of side panels, each side panel comprising openings enabling airflow into the housing;

an access panel, said access panel coupled between two side panels wherein the access panel and side panels form an enclosure;

an orifice ring mounted within said housing, wherein a running clearance between said distal end of said fan blades and said orifice ring has a first spacing;

a cover fastened atop the enclosure, said cover comprising a grill having a plurality of grill members, wherein said grill members are separated by a second spacing, which is smaller than the first spacing; and a relief air vent, said relief air vent extending over said orifice ring, through an opening formed in the access panel, and extending beneath said cover.

14. The system according to claim 13 wherein the relief air vent is ⅓ square feet in area.

15. The system according to claim 13, wherein the second spacing is 25-40 percent smaller than the first spacing.

16. The system according to claim 13, wherein the HVAC unit is a heat pump.

17. The system according to claim 13, further comprising relief air vents formed in one or more of the plurality of said side panels, said relief air vents extending over said orifice ring, through an opening formed in the one or more side panels, and extending beneath said cover.

18. A protective housing for a heating, ventilation, and air conditioning (HVAC) unit having a fan therein, said fan comprising a plurality of fan blades each blade having a proximal and distal end, the housing comprising:

a plurality of side panels, each side panel comprising openings enabling airflow into the housing;

an access panel, said access panel coupled between two of the plurality of side panels, wherein said access panel and said plurality of side panels form an enclosure;

an orifice ring mounted within said housing, wherein a running clearance between said distal ends of said fan blades and said orifice ring has a first spacing;

a cover fastened atop the enclosure, said cover comprising a grill having a plurality of grill members, wherein said grill members are separated by a second spacing, which is smaller than the first spacing; and relief air vents formed in one or more of the plurality of said side panels, said relief air vents extending over said orifice ring, through an opening formed in the one or more side panels, and extending beneath said cover.

* * * * *